US005688604A

United States Patent [19]

Matan et al.

[11] Patent Number: 5,688,604

[45] Date of Patent: Nov. 18, 1997

[54] DEFORMABLE AND ELASTIC TENSILE-INTEGRITY STRUCTURE

[76] Inventors: Ofer J. Matan, 310 Palo Alto Ave., Palo Alto, Calif. 94301; Illah R. Nourbakhsh, P.O. Box 12104, Stanford, Calif. 94309

[21] Appl. No.: 505,472

[22] Filed: Jul. 21, 1995

[51] Int. Cl.[6] ..... E04B 1/19

[52] U.S. Cl. ..... 428/542.2; 52/81.2; 52/646

[58] Field of Search ..... 428/9, 12, 542.2; 52/81.2, 646

[56] References Cited

U.S. PATENT DOCUMENTS

| | | | |
|---|---|---|---|
| 3,063,521 | 11/1962 | Fuller | 52/646 |
| 3,690,998 | 9/1972 | Brynjegard | 428/542.6 |
| 3,695,617 | 10/1972 | Mogilner et al. | 428/542.6 X |
| 3,766,932 | 10/1973 | Sidis et al. | 52/646 X |
| 4,148,520 | 4/1979 | Miller | 52/648.1 X |
| 4,731,962 | 3/1988 | Kittner et al. | 52/646 X |

*Primary Examiner*—Henry F. Epstein

*Attorney, Agent, or Firm*—Lumen Intellectual Property Services

[57] ABSTRACT

A tensile-integrity (tensegrity) structure which automatically and elastically returns to its original shape after deformation comprises compression units (e.g. struts) [11] connected together by elastic tensile units (e.g. elastic chords) [13]. Each elastic chord [13] connects the extreme tip [12] of a first side strut to a midpoint [15] of a center strut. The extreme tip of a second side strut is similarly connected to the midpoint of the center strut by an elastic chord.

7 Claims, 6 Drawing Sheets

DEFORMABLE AND ELASTIC TENSILE-INTEGRITY STRUCTURE

BACKGROUND—FIELD OF INVENTION

This invention relates to tensegrity structures, specifically to elastic and deformable tensegrity spheres used as toys.

BACKGROUND—DISCUSSION OF PRIOR ART

The tensile-integrity (tensegrity) sphere was introduced by Richard Buckminster Fuller (1962) in U.S. Pat. No. 3,063,521 as an exoskeletal structure maximizing structural strength while minimizing strutural weight by employing octahedral tensile-integrity units called tensegrities. Following Fuller's invention, the concept of tensegrity has been used to create highly collapsible structures such as Ross Miller's (1979) collapsible chair in U.S. Pat. No. 4,148,520 and collapsible reticular structures by Abraham Sidis (1973) in U.S. Pat. No. 3,766,932.

Elastic cord has been used in tensegrity kits for ease of connection and to allow for variable-length tensile members, as in Kittner's (1988) U.S. Pat. No. 4,731,962. The elastic tensile units in these kits lie parallel to the compression struts allowing easy connection at the center of the cord. The purpose of these kits is mainly educational and the use of elastic makes the kit versatile. These designs are not intended as long-term connections and are not designed to withstand large deformations such as flattening. Had these designs employed elastic cord with greater deformability, the resultant structures would be highly deformable but also prone to entanglement following deformation.

In addition, elastic cord has been used in the tensile element to construct pliable icosahedrons for infant play (Design by Tom Flemons, Vancouver, B. C.). This design has the property of perfect elasticity (i.e. perfect return to original form after deformation). This property is due to an icosahedron's arrangement of interior compressive elements. This solution does not extend to general tensegrity structures such as tensegrity spheres that are exoskeletal.

OBJECTS AND ADVANTAGES

Accordingly, it is an object of the present invention to create exoskeletal tensegrity structures capable of being thrown, bounced, and kicked as are traditional air-filled or foam-filled toys. FIG. 1 pictures such an exoskeletal tensegrity sphere toy.

Prior art has primarily been in kit form, resulting in design for the creation of temporary structures having little or no bounciness, no resilience nor other toy-like properties (see, for example, Kenner, Hugh, *BUCKY: A Guided Tour of Buckminster Fuller*, William Morrow & Co., New York, 1973, pp. 88–89).

To this end, it is an object of the present invention to combine the quality of extreme deformability with the resilience of perfect elasticity to create an exoskeletal tensegrity structure that can be flattened and further contorted and will return elastically to its original shape. Several tensegrity structures exist in kit form. Some of these kits have insufficiently elastic tensile members, preventing the structures from being flattened. Other kits have highly elastic members but suffer from connection geometries that allow entanglement upon deformation (an example of such a kit is the Stik Trix Construction Puzzle produced by Tensegrity Systems Corp. in Tivoli, N.Y.).

In keeping with these objects, a feature of this structure is the geometry of the elastic tensile-compression connections.

This geometry must guarantee the elasticity of the structure as a whole because it is precisely these connections which, when interfering with one-another or undergoing deformation, are in danger of causing entanglement in unintended configurations.

The details of the elastic tensile connections are set forth in particular in the appended claims. The motivation for this enabling geometry and its mechanical ability to sustain the structure's perfect elasticity as well as further objects and advantages can be best understood from the following description and drawings.

REFERENCE NUMERALS IN DRAWINGS

Figure 1:
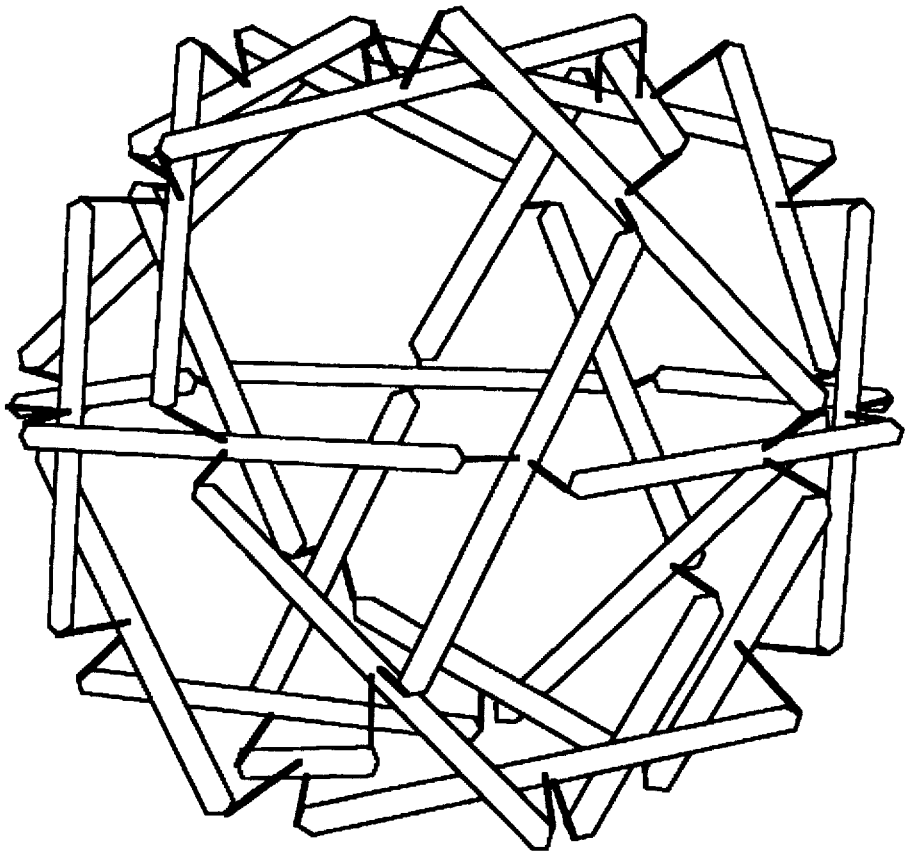
FIG. 1 is a perspective view of a deformable, elastic tensegrity sphere toy

11 strut
12 tip of strut
13 elastic-tensile unit
14 side compression unit (or side strut)
15 fixture
16 center compression unit (or center strut)
17 midpoint of strut
18 tip of elastic-tensile unit
19 lateral hole
20 surface
21 staple
22 submarining strut
23 submarining strut tip
24 submarined strut midpoint
25 elastic chord
26 strut tip extension beyond chord connection point
27 longitudinal interior of strut

SUMMARY

The invention is an elastic tensile-integrity connection to be used in exoskeletal tensegrity structures and in particular tensegrity spheres such that the structure (a) allows deformability to a plane (flattening) and beyond. Furthermore (b) the structure exhibits perfect elastic recovery to its original shape upon cessation of distorting pressure. FIG. 1 pictures a tensegrity sphere demonstrated to have these properties.

Specifically, the connection is comprised of elastic tensile units connecting to compressive struts at extreme strut tips, coaxial with the longitudinal strut axis, and at the midpoints of center struts, fixed with respect to lateral movement across the strut midpoint.

The structure may be alternately viewed as being comprised of a group of elastic tensile-compression units which are connected to one another by attachment of the compressive component to the elastic component.

DESCRIPTION OF INVENTION

Every strut in a genetic tensegrity structure is a compound compressive element comprising two compressive elements of Fuller's original tensegrity struts, those being adjacent and colinear tensegrity struts. A resultant embodiment, the tensegrity sphere, is described in detail in Kenner, Hugh, *BUCKY: A Guided Tour of Buckminster Fuller*, William Morrow & Co., Inc., New York, 1973.

In this invention, each strut of the tensegrity structure supports four points of tensile attachment. Specifically, this invention connects the tips of each strut to the midpoints of side struts via elastic tensile members. Having chosen the format of the connecting tensile members, we require the connection geometry specified below to ensure the perfect elasticity of the tensegrity sphere as a whole.

Figure 2:
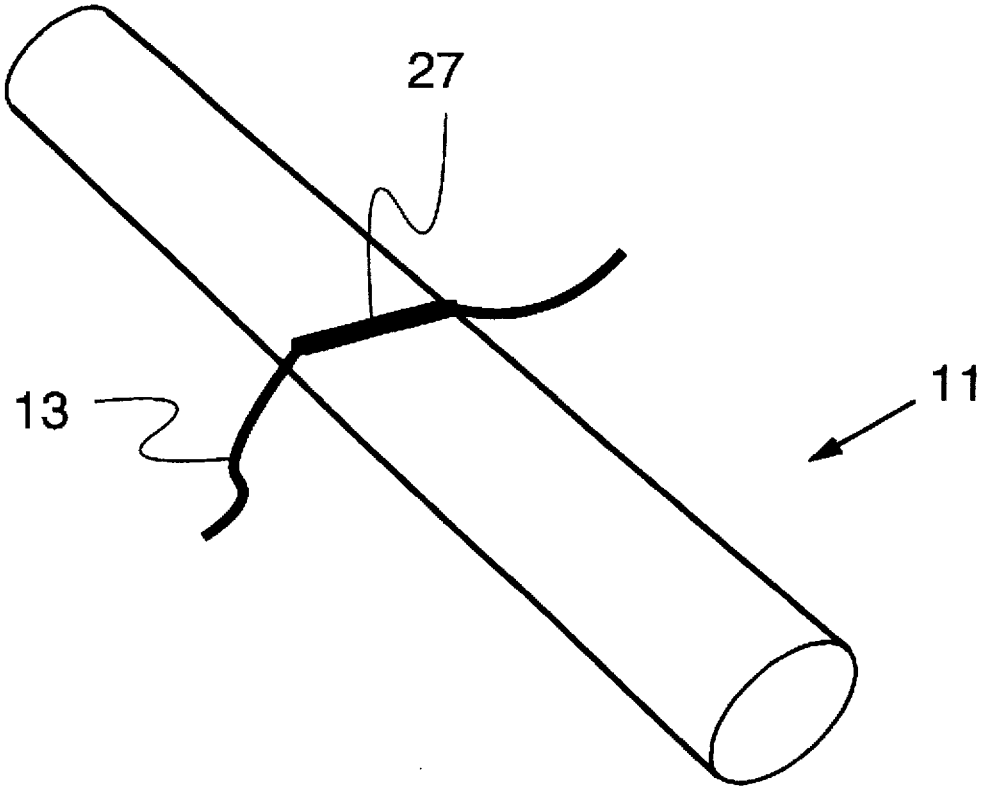
FIG. 2 is a perspective view of a tension-compression unit.

FIG. 2 depicts an elastic tensile-compression unit. An elastic tensile-compression unit is comprised of a strut, or compression unit 11 and an elastic tensile unit 13 attached externally or internally to longitudinal interior 27 of strut 11.

Figure 3:
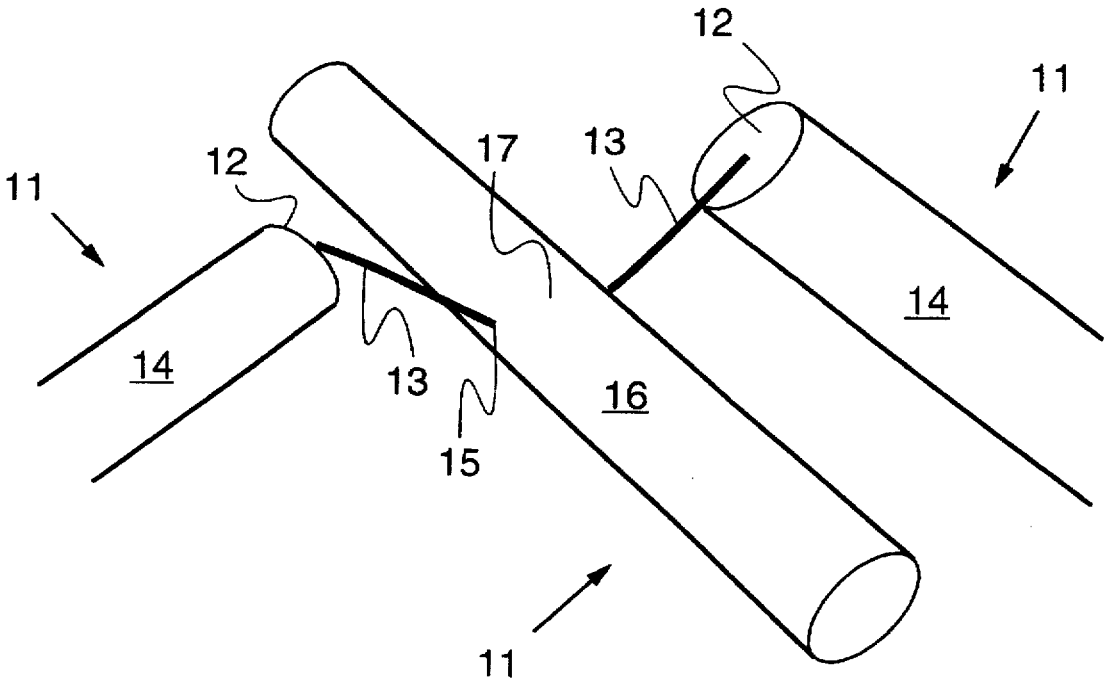
FIG. 3 is a perspective view of an abstract tension-compression connection.

FIG. 3 depicts an abstract tensile-integrity connection as used in the tensegrity sphere toy. Each connection involves three struts or compression units 11, one being a center strut 16 and two being side struts 14. An elastic tensile unit 13 attaches to side struts 14, specifically to tips of struts 12 and to a midpoint 17 of center strut 16. The midpoint connection 17 is in fact a fixture 15 of elastic tensile unit 13 with respect to lateral movement against center strut 16.

Figure 4:
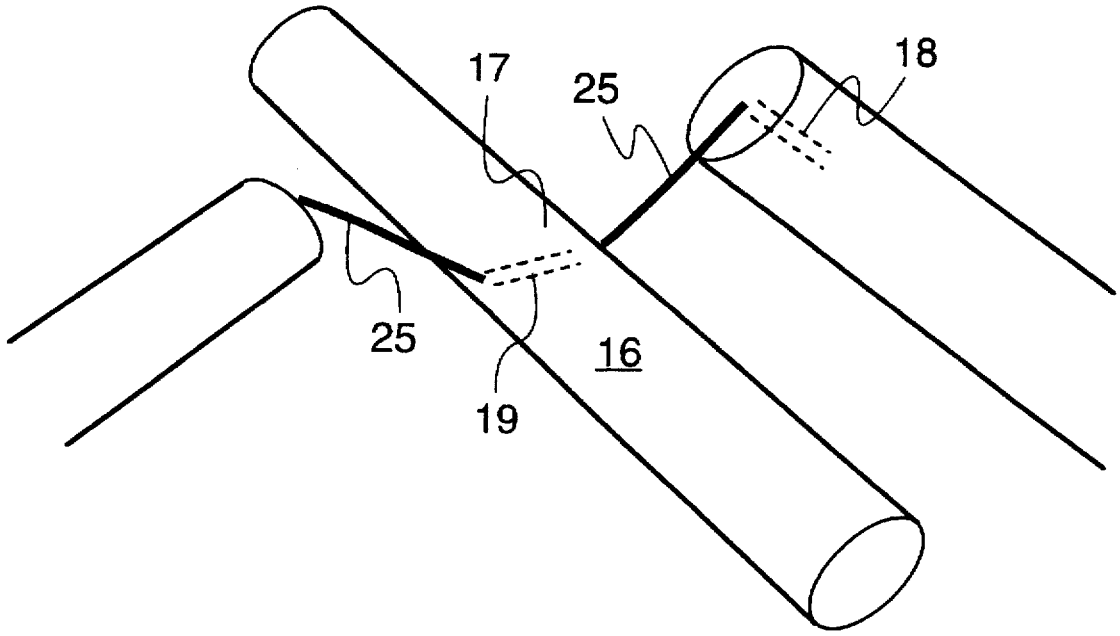
FIG. 4 is a perspective view of a mid-strut through-strut connection.
Figure 5:
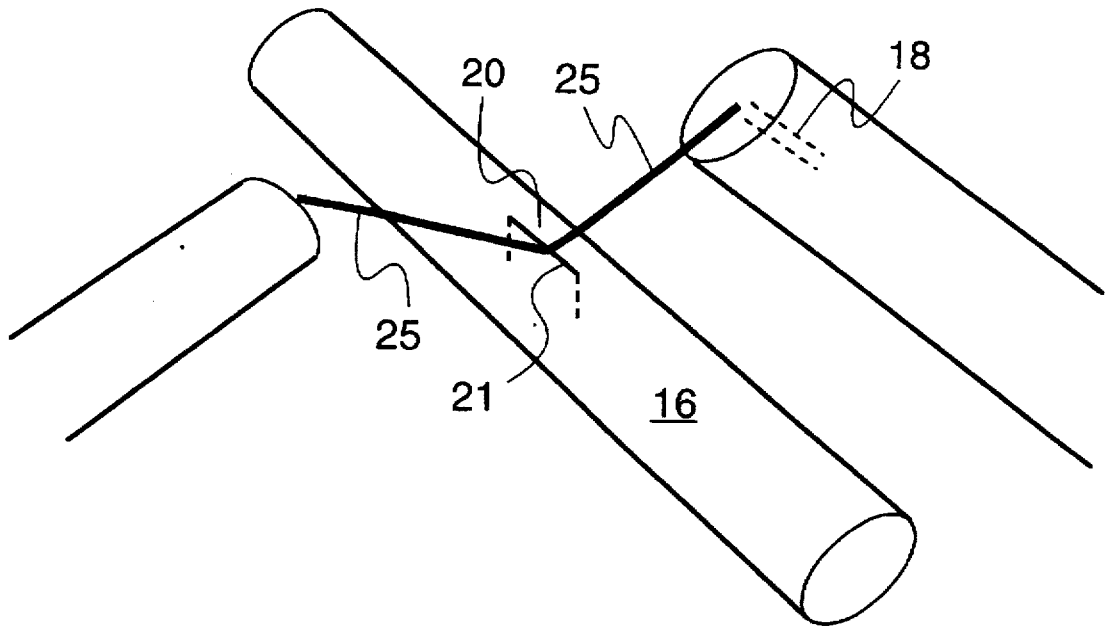
FIG. 5 is a perspective view of a mid-strut surface connection.

FIG. 4 and FIG. 5 depict two embodiments of the connection geometry of FIG. 3 using a single piece of elastic cord. In both FIG. 4 and FIG. 5, elastic cord or elastic-tensile units 25 attach to tips of struts specifically by insertion of tips of elastic-tensile units 18 longitudinally coaxial with side struts.

In FIG. 4, a lateral hole 19 in center strut 16 is positioned at a midpoint 17 and approximately perpendicular to the longitudinal axis of strut 16. Cord 25 passes through hole 19 between symmetric strut-tip connections. An important caveat, however, is that the position of cord 25 must be fixed with respect to hole 19, as this cord 25 must dynamically act like two separate tensile units that connect center strut midpoint 17 to two opposing side strut tips. Otherwise, cord 25 will slip laterally through hole 19, causing the mount of elastic on the two sides of midpoint 17 to be unequal and thus resulting in distortion of resultant tensegrity structure.

In FIG. 5, a cord 25 is attached to a surface 20 of strut 16, again at a fixed point to ensure that cord 25 does not slide laterally. This attachment can be effected as shown through the use of a staple 21.

OPERATION AND THEORY OF INVENTION

Elastic tensile-integrity connections described by this invention may be combined to construct exoskeletal tensegrity structures. These structures may be deformed fully flat and beyond and will return to the original shape upon cessation of pressure, thus displaying perfect elasticity despite a high degree of deformability. For instance, the structure can be deformed well beyond the plane by bunching to create a set of aligned struts forming a rough cylinder. Cessation of pressure will cause the structure to revert to its original shape. It is our intention that the elastic be capable of reaching a sufficient length under pressure as to allow this type of full deformation to take place.

Two dynamic qualifies of the geometry described above allow resultant tensegrity structures to attain perfect elasticity. The first is a torque moment relative to the axis of each strut equalizing the altitude of the side strut tips. This torque contributes to the maintenance of the symmetry of each tensile-integrity connection, and therefore to the symmetry of the tensegrity structure as a whole.

The maximum such stabilizing torque can be supplied if the midpoint strut-cord attachments are at the exterior surface of each strut, as in FIG. 5; however, attachment at points as low as those in FIG. 4 have proven experimentally to provide sufficient stability for elastic shape recovery following deformation.

Figure 6:
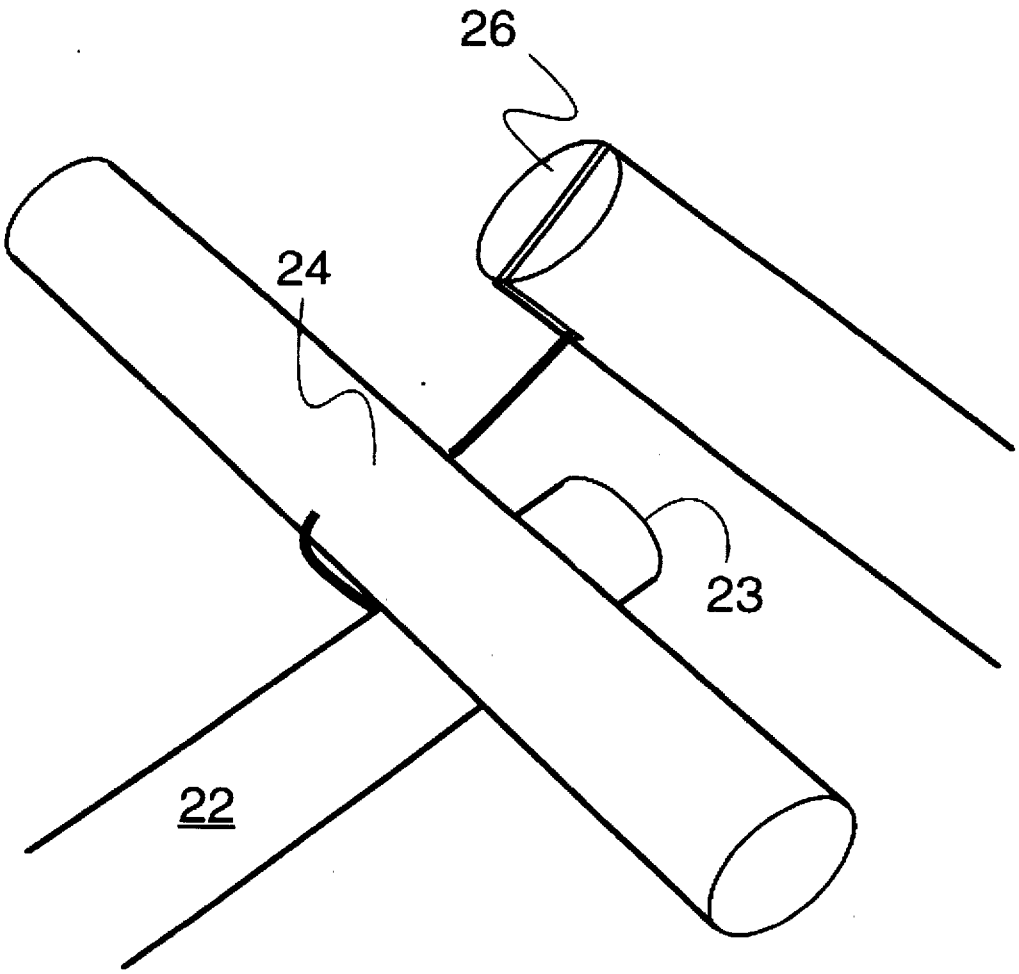
FIG. 6 is a perspective view of a submarined strut as can be encountered by traditional, laterally slotted tension-compression joints.

The second dynamic quality is prevention of the submarining of the strut-tips below the midpoint of center struts. FIG. 6 depicts such submarining by strut 22. Although the dynamic aspects of cord elasticity and corresponding cord length play a role in this requirement, a key geometric requirement is that mechanical obstruction must not provide a local energy minimum for the submarined state by requiring outward movement of the strut when transitioning from a submarined position to the correct position for the structure's symmetric shape. FIG. 6 depicts such a submarined strut tip 23 entangled underneath its submarining midpoint connection 24, as can occur in existing tensegrity kits that have strut tip extension 26 beyond the cord connection point. This is often the case when the cord is attached to the strut tip through a slot cut longitudinally into and laterally through the strut tip.

Conclusions, Ramifications, and Scope

Accordingly, the reader will see that the elastic tensile connections described above allow the construction of exoskeletal tensegrity structures that can undergo high amounts of deformation, including deformation of the structure to a plane and beyond, while retaining the ability to return automatically to the original shape upon cessation of deformational pressure.

Any apparent specification of materials or other specificities unrelated to the qualities of perfect elasticity and high deformability should not be construed as limitations on the scope of the invention, but rather as an exemplification of preferred embodiments. The tensegrity sphere is only one embodiment of exoskeletal structures that can be constructed using this invention. For example, highly deformable enclosures, such as portable tent systems, represent another embodiment in which the compactness that results from deformability and the tendency to avoid entanglement are extremely desirable properties. Accordingly, the scope of the invention should be determined by the appended claims and their legal equivalents.

We claim:

1. A deformable, elastic recovery tensile-integrity structure comprising:

a center strut having a fixture point;

a first side strut having a first extreme strut tip;

a first elastic chord having a first end fixed to the first extreme strut tip and a second end fixed to the fixture point of the center strut;

a second side strut having a second extreme strut tip; and a second elastic chord having a first end fixed to the second extreme strut tip and a second end fixed to the fixture point of the center strut;

whereby the tensile-integrity structure exhibits elastic recovery to its original shape after extreme deformation.

2. The tensile-integrity structure of claim 1 wherein the first extreme strut tip is located on a longitudinal axis of the first side strut, and the second extreme strut tip is located on a longitudinal axis of the second side strut.

3. The tensile-integrity structure of claim 1 wherein the first elastic chord and the second elastic chord are distinct portions of a common elastic chord.

4. The tensile-integrity structure of claim 1 wherein the fixture point is located at a midpoint of the center strut.

5. A deformable, elastic recovery tensile-integrity sphere comprising a plurality of struts and a plurality of elastic chords, wherein the struts and chords form a plurality of tensile-integrity connections, each connection comprising:

a center strut having a midpoint;

a first side strut having a first extreme strut tip;

a first elastic chord having a first end fixed to the first extreme strut tip and a second end fixed to the midpoint of the center strut;

a second side strut having a second extreme strut tip; and a second elastic chord having a first end fixed to the second extreme strut tip and a second end fixed to the midpoint of the center strut;

whereby the tensile-integrity sphere exhibits elastic recovery to its original shape after extreme deformation.

6. The tensile-integrity sphere of claim 5 wherein the first extreme strut tip is located on a longitudinal axis of the first side strut, and the second extreme strut tip is located on a longitudinal axis of the second side strut.

7. The tensile-integrity sphere of claim 5 wherein the first elastic chord and the second elastic chord are distinct portions of a common elastic chord.

* * * * *